US006250959B1

(12) United States Patent
Yamaguchi et al.

(10) Patent No.: US 6,250,959 B1
(45) Date of Patent: Jun. 26, 2001

(54) CONNECTOR FOR COAXIAL CABLES WITH VERY FINE CONDUCTORS

(75) Inventors: Tomisaburou Yamaguchi, Yokohama; Mitsuo Fujikura, Sagamihara; Hideki Iijima, Kawasaki; Yoshiyuki Mizuno, Kanagawa, all of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/503,407

(22) Filed: Feb. 14, 2000

(30) Foreign Application Priority Data

Mar. 3, 1999 (JP) ..... 11-054973

(51) Int. Cl.[7] ..... H01R 9/05
(52) U.S. Cl. ..... 439/578
(58) Field of Search ..... 439/417, 495, 439/578, 579, 610, 736, 497

(56) References Cited

U.S. PATENT DOCUMENTS

| | | | | |
|---|---|---|---|---|
| 3,696,319 | | 10/1972 | Olsson | 339/17 |
| 3,963,319 | | 6/1976 | Schumacher et al. | 339/176 |
| 4,188,086 | | 2/1980 | Inouye et al. | 339/176 |
| 4,191,441 | | 3/1980 | Ryder et al. | 339/17 |
| 4,477,137 | | 10/1984 | Ayer | 339/59 |
| 4,519,133 | | 5/1985 | Pansanel | 29/863 |
| 4,629,271 | | 12/1986 | Awano | 339/75 |
| 4,778,403 | | 10/1988 | Ikesugi et al. | 439/329 |
| 4,857,017 | | 8/1989 | Erk | 439/695 |
| 4,969,840 | | 11/1990 | Ii et al. | 439/495 |
| 5,106,311 | | 4/1992 | Yodogawa et al. | 439/77 |
| 5,194,017 | | 3/1993 | Consoli | 439/492 |
| 5,213,534 | | 5/1993 | Gardner et al. | 439/495 |
| 5,308,262 | | 5/1994 | Chishima | 439/495 |
| 5,370,552 | | 12/1994 | Chishima et al. | 439/495 |
| 5,387,125 | * | 2/1995 | Davis et al. | 439/497 |
| 5,397,247 | | 3/1995 | Aoki et al. | 439/496 |
| 5,417,581 | * | 5/1995 | Dechelette et al. | 439/393 |
| 5,433,632 | | 7/1995 | Cherney et al. | 439/495 |
| 5,474,468 | | 12/1995 | Chishima et al. | 439/495 |
| 5,541,365 | * | 7/1996 | Sugiura et al. | 439/874 |
| 5,639,260 | | 6/1997 | McHugh | 439/495 |
| 5,690,510 | | 11/1997 | Chishima | 439/496 |
| 5,727,968 | | 3/1998 | Ito | 439/495 |
| 5,816,845 | | 10/1998 | Chishima et al. | 439/495 |
| 5,882,223 | | 3/1999 | Igarashi | 439/495 |
| 5,928,027 | | 7/1999 | Kunishi | 439/495 |
| 6,007,366 | * | 12/1999 | Torri et al. | 439/397 |
| 6,116,948 | * | 9/2000 | Kunishi et al. | 439/495 |

* cited by examiner

*Primary Examiner*—Gary F. Paumen
*Assistant Examiner*—Phuongchi Nguyen
(74) *Attorney, Agent, or Firm*—Stephen Z. Weiss

(57) ABSTRACT

A connector is provided for terminating a plurality of generally parallel coaxial cables having fine conductor cores. The connector includes a dielectric housing having a slot. A plurality of terminals are mounted on the housing with contact portions spaced along the slot. A wire management member is insertable into the slot and includes a plurality of grooves for receiving the conductor cores and spacing the cores in alignment with the contact portions of the terminals. An actuator engages the wire management member and biases the conductor cores against the contact portions of the terminals.

17 Claims, 8 Drawing Sheets

CONNECTOR FOR COAXIAL CABLES WITH VERY FINE CONDUCTORS

FIELD OF THE INVENTION

This invention generally relates to connectors, such as electrical connectors, fiber optic connectors and the like, and, particularly, the invention is directed to a connector for terminating a plurality of coaxial cables having very fine conductor cores.

BACK GROUND OF THE INVENTION

A typical coaxial cable includes a center conductor core surrounded by a dielectric which, in turn, is surrounded by a shield such as a metallic braid or foil. An outer insulating sheath covers the cable. Heretofore, it has been typical to remove the outer sheath, shield and dielectric of each cable at an end thereof and solder the conductor core to a selected terminal in a connector.

Stripping the dielectrics of a plurality of coaxial cables and soldering each and every conductor core to its selected terminal is a laborious time-consuming process, and the conductor cores are prone to be cut during stripping. Therefore, insulation displacement terminals have been used to pierce the dielectric and establish contact with the conductor core of each terminal.

Still, problems continue to be encountered in terminating coaxial cables due to the ever-increasing miniaturization and high density of electronic circuitry. The coaxial cables continue to be made thinner and thinner, with the conductor cores becoming extremely fine. Correspondingly, it is increasingly difficult, if at all possible, to individually solder the conductor cores to the connector terminals. With insulation-displacement terminals, the terminals often are too wide for mounting the terminals in high density connectors at very narrow intervals.

It might be proposed to provide wire management grooves or passages in the connector housing for receiving the thin coaxial cables and/or fine conductor cores to align the cores with the terminals, but providing such means in the housing presents further molding problems as well as very difficult assembly problems. The present invention is directed to solving this myriad of problems in terminating coaxial cables.

SUMMARY OF THE INVENTION

An object, therefore, of the invention is to provide a new and improved connector for a plurality of generally parallel coaxial cables having fine conductor cores.

In the exemplary embodiment of the invention, the connector includes a dielectric housing having a slot. A plurality of terminals are mounted on the housing in a side-by-side arrangement, with contact portions closely spaced along the slot. A wire management member is provided for insertion into the slot and includes a plurality of side-by-side grooves for receiving the conductor cores of the cables and spacing the cores in alignment with the contact portions of the terminals. An actuator is mountable on the housing for engaging the wire management member and biasing the conductor cores against the contact portions of the terminals.

As disclosed herein, the slot in the housing is elongated and the wire management member includes an elongated plate having grooves on one side thereof in a generally parallel array. Means are provided on the wire management member for retaining the conductor cores in the grooves. In the preferred embodiment, the retaining means comprise restrictions, such as deformable tabs, generally at the mouths of the grooves for capturing the conductor cores in the grooves.

The terminals are shown herein to include bifurcated portions defining spaced legs between which the wire management member and conductor cores are inserted. One of the legs of each terminal forms the contact portion thereof. The legs are spaced sufficiently for also receiving a pressing portion of the actuator therebetween. The preferred embodiment also has insulation displacement means on the legs which define the contact portions of the terminals, for piercing through the insulation about the conductor cores of the coaxial cables.

A further feature of the invention includes a pair of ground plates sandwiching the coaxial cables therebetween in an area of shielded sections of the cables. A shield is provided about at least a portion of the housing, and the shield is engageable with at least one of the ground plates.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
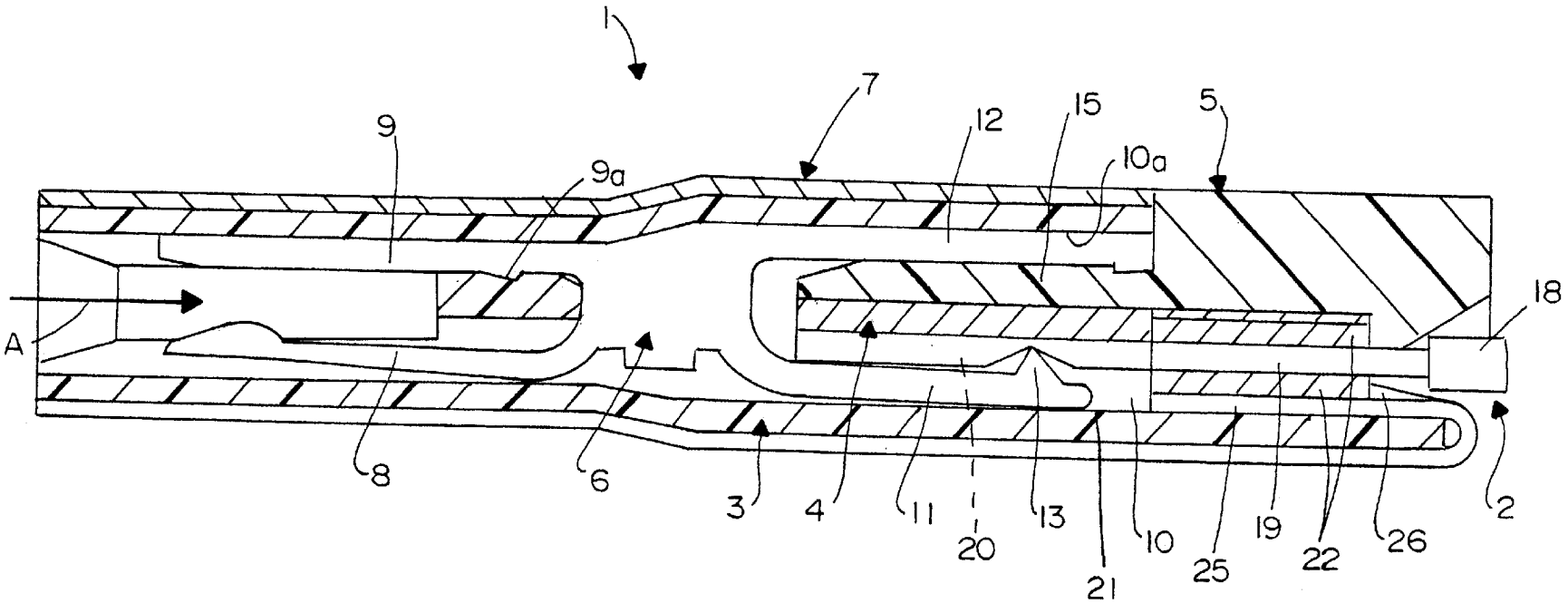
FIG. 1 is a front-to-rear section through a connector according to one embodiment of the invention.

Referring to the drawings in greater detail, and first to FIGS. 1–4 and 9, the invention is embodied in a connector, generally designated 1, for terminating a plurality of generally parallel coaxial cables, generally designated 2. The coaxial cables may be individual or discrete cables, or the cables may comprise integral components of a ribbon cable as shown somewhat schematically in FIG. 4. The connector includes a dielectric housing, generally designated 3; a wire management member, generally designated 4; an actuator, generally designated 5; and a plurality of terminals, generally designated 6, mounted in the housing and spaced longitudinally thereof at regular intervals. A shield, generally designated 7, substantially surrounds the housing.

More particularly, as best seen in FIG. 1, each terminal 6 includes a bifurcated or U-shaped mating end defined by a bottom leg 8 and a top leg 9 for receiving the mating portion of a complementary mating connector therebetween in the direction of arrow "A". Each terminal is inserted into an elongated slot 10 in housing 3 and is retained therein by a retention barb 9*a* on the inside of upper leg 9 at the mating end of the terminal skiving into the plastic material of the housing. Each terminal has an opposite of terminating end which is bifurcated or U-shaped to define a bottom leg 11 and a top leg 12. The bottom leg includes an inwardly directed insulation-displacing barb 13. Top leg 12 is biased against a ceiling 10*a* of slot 10.

Figure 2:
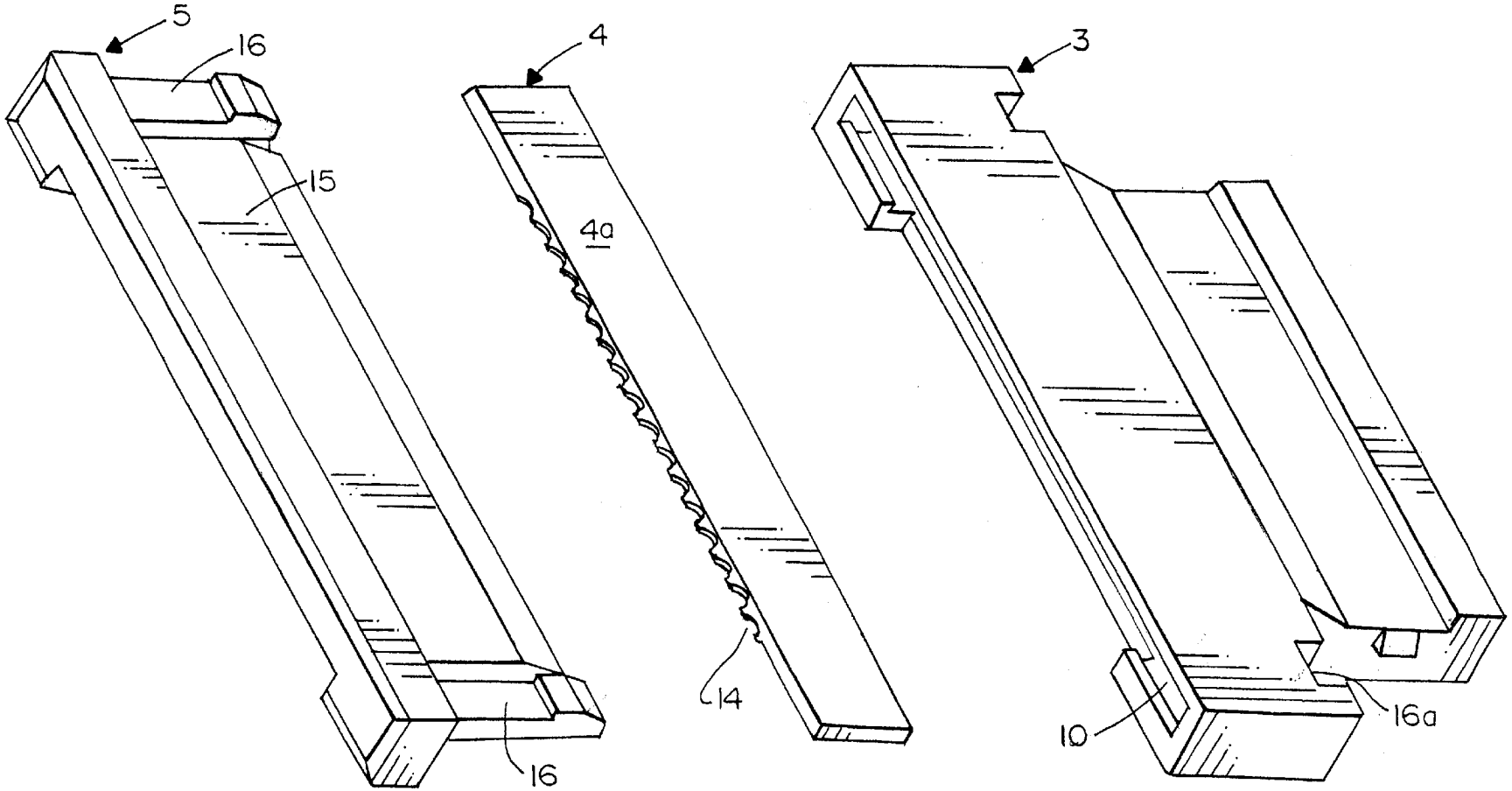
FIG. 2 is an exploded perspective view of the three major components of the connector.

Wire management member 4 can be generally plate-like as seen in FIG. 2. The wire management member is molded of dielectric material such as plastic or the like and includes a plurality of closely spaced parallel grooves 14 molded in a side-by-side array on one side of the member. As will be seen hereinafter, grooves 14 are arranged to receive the fine conductor cores of coaxial cables 2, and the grooves are spaced so that they are arranged in a one-to-one corresponding relation with legs 11 and barbs 13 of terminals 6.

Figure 9:
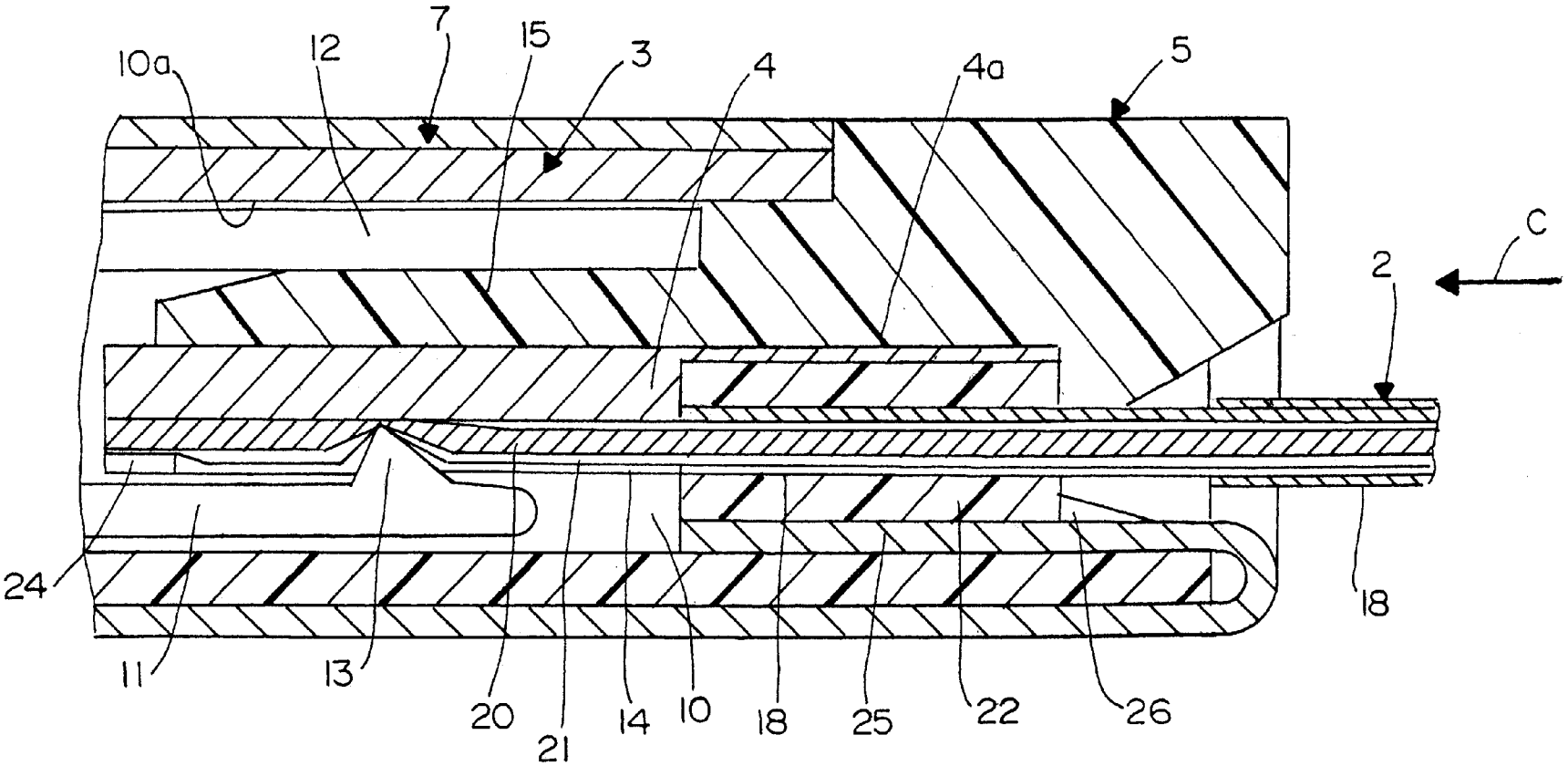
FIG. 9 is a fragmented, enlarged section of the right-hand portion of the depiction in FIG. 1.

Actuator 5 also can be molded of dielectric material such as plastic or the like. The actuator includes a central pressing plate 15 spaced between a pair of end latches 16. When actuator 5 is inserted into slot 10 in housing 3, pressing plate 15 engages the top smooth surface 4*a* of wire management member 4 until latches 16 engage latch notches 16*a* (FIG. 2) in the ceiling of slot 10 at opposite ends of housing 3. The top of pressing plate 15 is engageable with upper legs 12 of terminals 6 which, in turn, are in abutment with ceiling 10*a* of the housing as best seen in FIGS. 1 and 9.

Housing 3 also is molded of dielectric material such as plastic or the like. The housing (along with wire management member 4 and actuator 5) is elongated, and slot 10 extends substantially the entire width or elongation of the housing.

Figure 4:
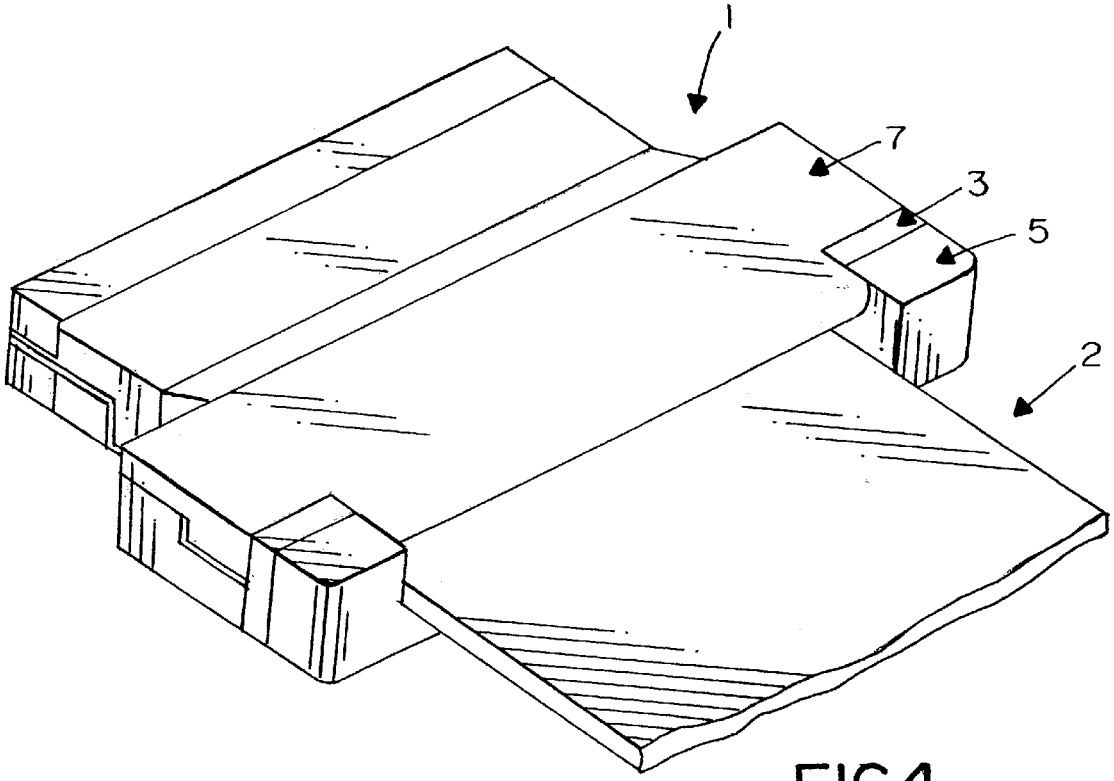
FIG. 4 is a bottom perspective view of the fully assembled connector.
Figure 5:
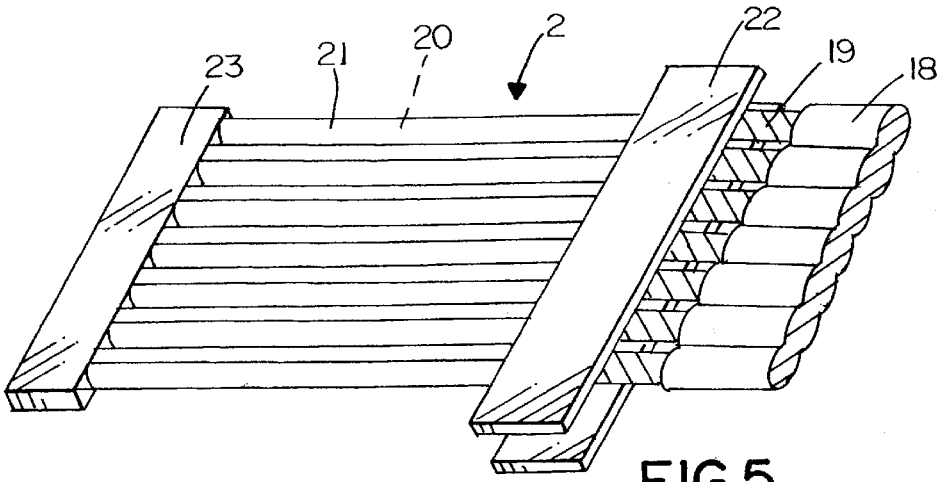
FIG. 5 is a perspective view of a plurality of coaxial cables with stripped ends, and in conjunction with the ground plates.

FIG. 4 shows connector 1 terminated to a ribbon (or set) of coaxial cables 2. The coaxial cables are generally parallel and in a flat array. Referring to FIG. 5, each coaxial cable 2 includes a single conductor core 20 surrounded by a dielectric or insulation 21. Therefore, the cores are not visible in the drawings. A shield 19, such as a foil or braid, surrounds dielectric 21, and an outer sheath 18 surrounds the shield. It should be understood that the invention is equally applicable for terminating a plurality of discrete coaxial cables, whereby outer sheaths 18 will comprise individual tube-like covers, or a composite ribbon cable whereby the outer covering is a continuous flat structure as show in FIG. 4.

Referring to FIGS. 5—9, the manner in which coaxial cables 2 are prepared and connected to connector 1 now will be described.

First, outer sheath or sheaths 18 and shields 19 are removed from the ends of the coaxial cables to expose dielectrics 21 covering conductor cores 20 as seen in FIG. 5. Two conductive metal ground strips or plates 22 are applied and soldered to the upper and lower areas of shields 19 and, thereby, sandwich the cables therebetween in the areas of the stripped cables exposing shields 19. A fixture 23 is clamped to the very distal ends of the stripped conductor cores with dielectrics 21 thereabout, as seen in FIG. 5, to precisely space the conductor cores.

Figure 6:
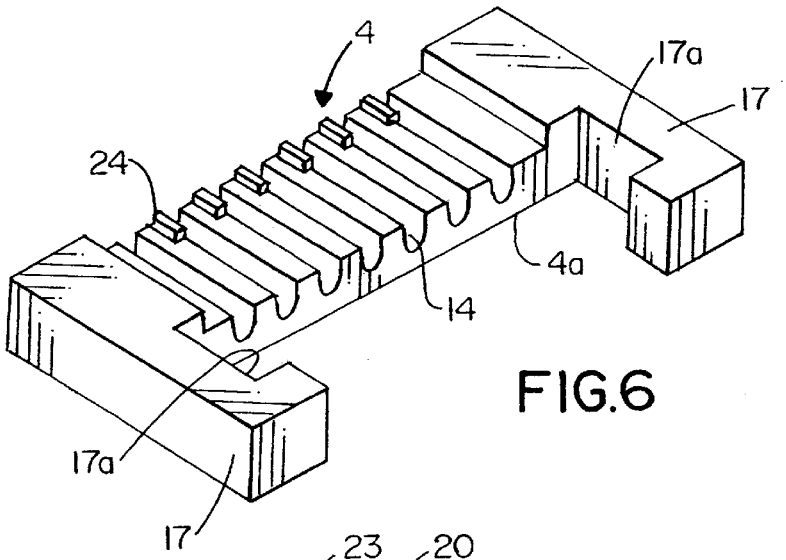
FIG. 6 is a bottom perspective view of the wire management member of the connector.
Figure 7:
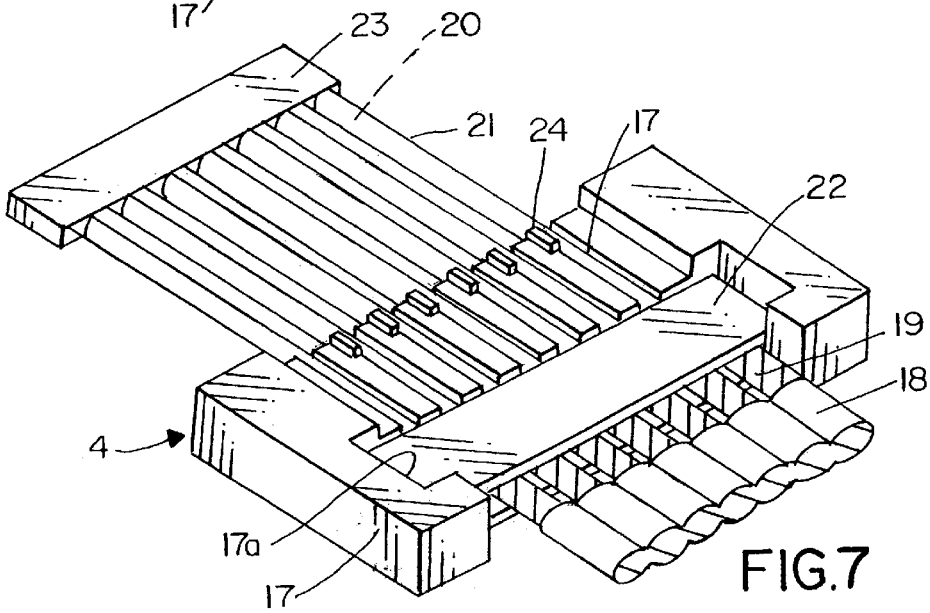
FIG. 7 is a perspective view of the subassembly of FIG. 5 inserted into the wire management member of FIG. 6.
Figure 8:
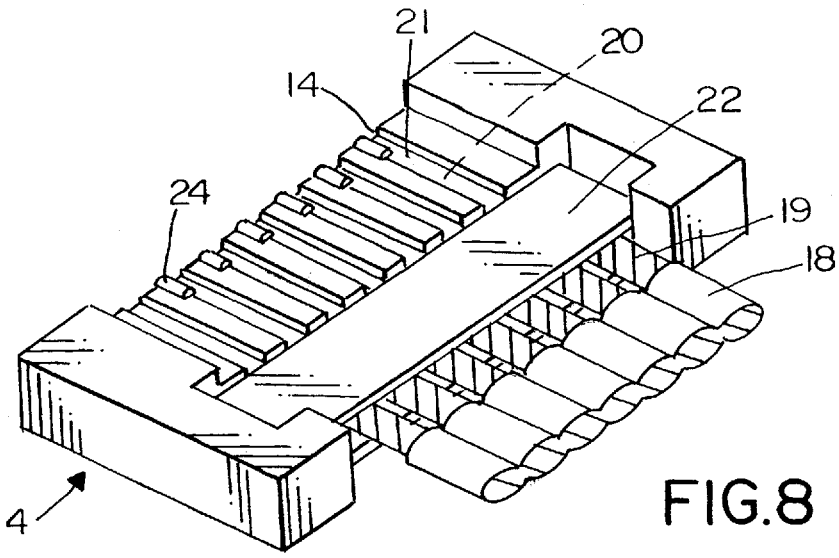
FIG. 8 is a view similar to that of FIG. 7, with the ends of the conductor cores cut-off and removed.

Wire management member 4 in FIGS. 6–8 is somewhat different from the simpler plate-like member in FIG. 2. Specifically, the wire management member in FIGS. 6–8 has hook-like extensions 17 at opposite ends thereof. The wire management member may be molded of dielectric material such as plastic or the like. A retention tab 24 is molded integrally with the plastic member adjacent each core-receiving groove 14 as seen in FIG. 6.

Referring to FIG. 7, the subassembly shown in FIG. 5 and described above is assembled to wire management member 4, as shown. Ground plates 22 fit within recesses 17a on the insides of extensions 17 of the wire management member, as by a press-fit. Fixture 23 and the ends of conductor cores 20 and dielectrics 21 then are cut-off as seen in FIG. 8.

The subassembly of FIG. 8 then is inverted from the orientation shown and is inserted into elongated slot 10 of housing 3 in the direction of arrow "B" (FIG. 9). Actuator 5 then is inserted into slot 10 in the direction of arrow "C". During insertion, pressing plate 15 of the actuator engages smooth top side 4*a* of wire management member 4 to press the wire management member toward lower legs 11 of the terminals. This biases conductor cores 20 (surrounded by dielectrics 21) into engagement with insulation displacing barbs 13 which pierce through dielectrics 21 and establish contact with conductor cores 20, thus making electrical connections between terminals 6 and coaxial cables 2. FIG. 9 clearly shows how pressing plate 50 engages or is sandwiched beneath upper legs 12 of the terminals, the upper legs being in abutment with ceiling 10*a* of slot 10 of housing 3.

It can be seen that wire management member 4 is effective as an interposer structure between actuator 5 and the contact portions of the terminals. The wire management member is effective to precisely space and maintain the positioning of the very fine conductor cores of the coaxial cables. In essence, actuator 5 never engages the conductor cores but applies pressure thereto through the wire management member.

Figure 3:
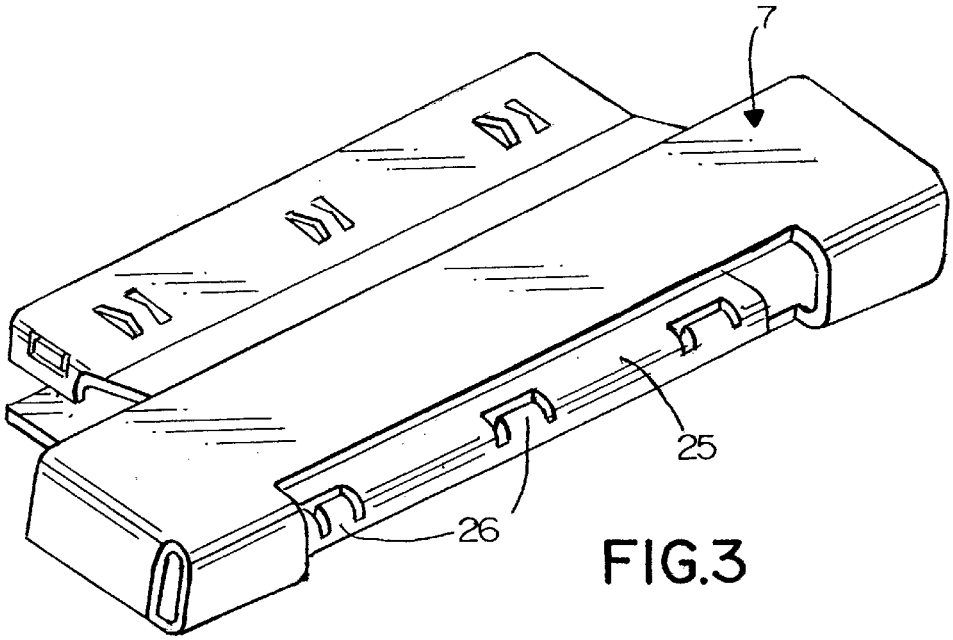
FIG. 3 is a perspective view of the connector shield.

After the actuator is fully inserted and latched, connector shield 7 engages one of the ground plates 22 soldered to the shields of the coaxial cables. More particularly, as seen in FIG. 3, the shield has a rear end 25 with laterally spaced projections 26. The shield may be stamped and formed of conductive sheet metal material, and projections 26 can be stamped therefrom and bent to project inwardly thereof. Referring to FIG. 9, it can be seen that the lower ground plate 22 engages end portion 25 of shield 7, and projections 26 are snapped behind the ground plate. This prevents the subassembly of FIG. 8 from pulling out of slot 10 in housing 3.

Figure 10:
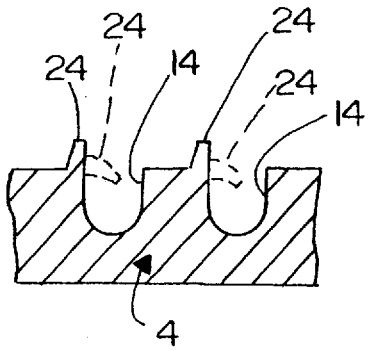
FIG. 10 is a fragmented, enlarged section through two of the grooves of the wire management member.

FIG. 10 shows a pair of the retention tabs 24 adjacent the edges of grooves 14 in wire management member 4. After the conductor cores surrounded by their dielectrics are positioned within grooves 14, retention tabs 24 can be deformed as shown by dotted lines in FIG. 10 so that the retention tabs close grooves 14 and retain the conductor cores therewithin. In essence, the retention tabs comprise restrictions generally at the mouths of the grooves.

Figure 11:
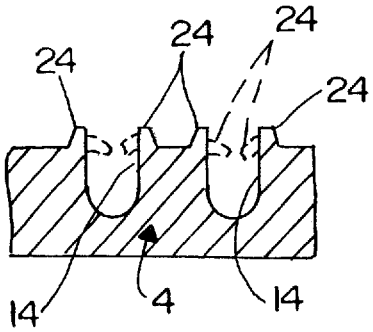
FIG. 11 is a view similar to that of FIG. 10, but of an alternate embodiment of the wire management member.

FIG. 11 shows an alternate embodiment wherein retention tabs 24 are provided at both opposite sides of each groove 14 in the wires management member. Again, the retention tabs are deformed inwardly into the groove, as shown by the dotted lines, to retain the conductor cores in the grooves.

Figure 12:
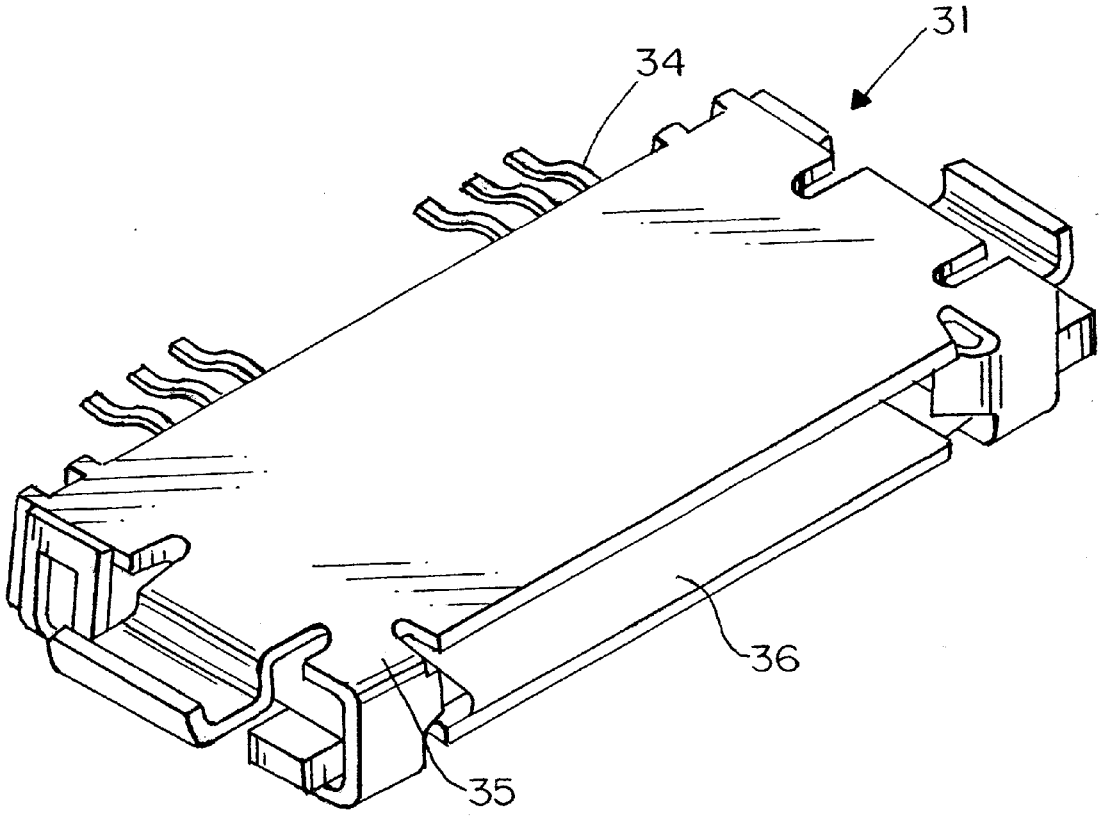
FIG. 12 is a perspective view of a complementary connector for mating with the connector of FIGS. 1–11.
Figure 13:
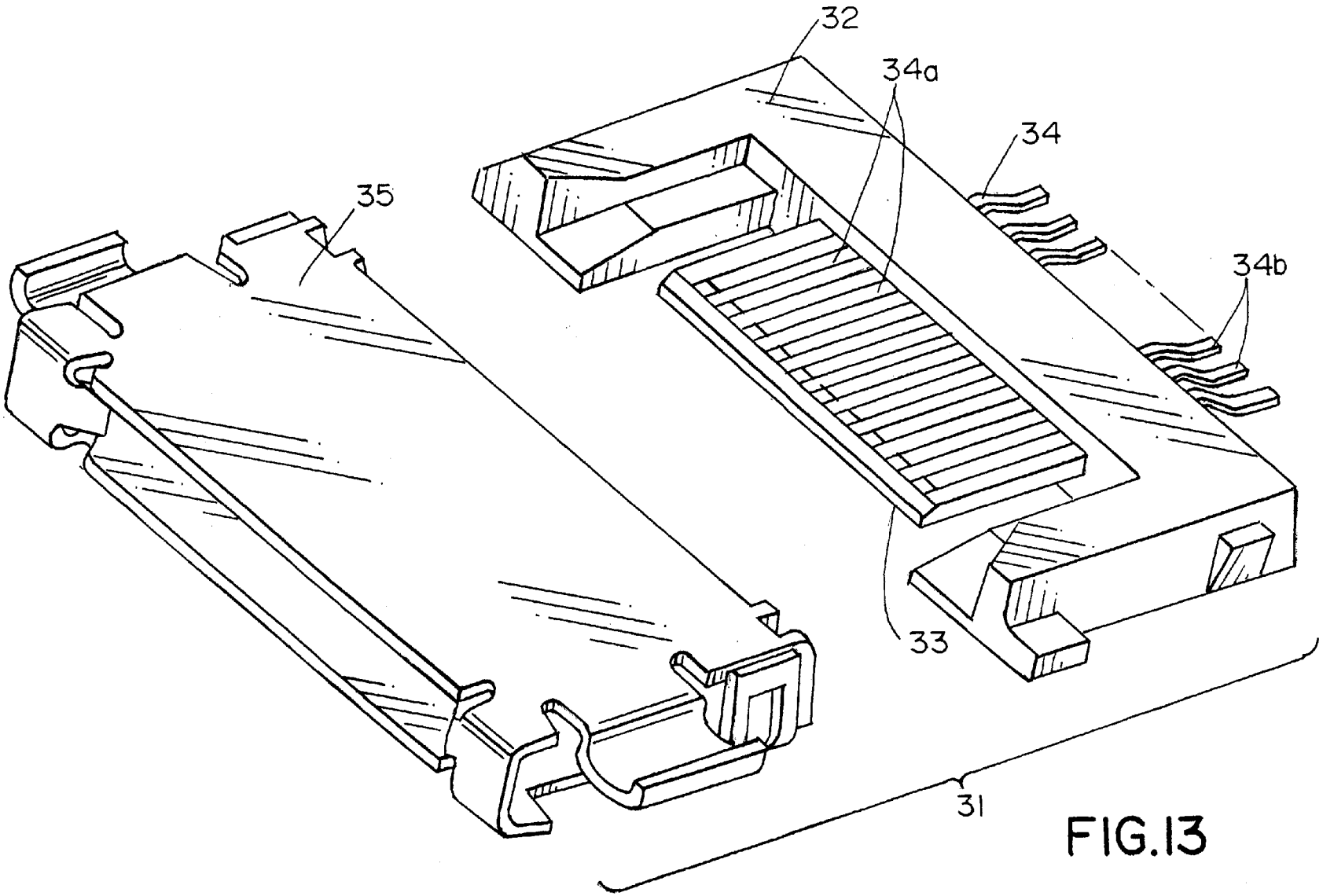
FIG. 13 is a perspective view of the mating connector, with the shield removed.

Finally, FIGS. 12 and 13 show a complementary mating connector, generally designated 31, to which connector 10 is mateable. Mating connector 31 includes a housing 32 having a plug portion 33. A plurality of terminals 34 are mounted in the housing and include contact portions 34*a* on one or both sides of plug portion 33 and tail portions 34*b* projecting rearwardly of the housing. The housing may be molded of dielectric material such as plastic or the like, with a stamped and formed sheet metal shield 35 surrounding the housing.

Connector 1 is mated with mating connector 31 by inserting the front end (the left-hand side of connector 1 in FIG. 1) of connector 1 into an elongated opening 36 (FIG. 12) of mating connector 31. Plug portion 33 of the mating connector moves between legs 8 and 9 of terminals 6 as indicated by arrow "A" in FIG. 1 until contact portions 34*a* of the mating connector engage terminals 6 of connector 1. Shield 7 of connector 1 engages the inner surfaces of shield 35 of mating connector 31.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector for a plurality of generally parallel coaxial cables having fine conductor cores, comprising:

a dielectric housing having a slot;

a plurality of terminals mounted on the housing in a side-by-side arrangement with contact portions spaced along the slot;

a wire management member for insertion into the slot and including a plurality of side-by-side grooves for receiving the conductor cores and spacing the cores in alignment with the contact portions of the terminals; and an actuator separate from the wire management member for engaging the wire management member and biasing the conductor cores against the contact portions of the terminals.

2. The connector of claim 1 wherein said slot is elongated and said wire management member includes an elongated plate having said grooves on one side thereof in a generally parallel array.

3. The connector of claim 1 wherein said contact portions of the terminals include insulation displacement means for piercing through insulation about the conductor cores of the coaxial cables.

4. The connector of claim 1 wherein said terminals include bifurcated portions defining spaced legs between which the wire management member and conductor cores are inserted, one of said legs of each terminal comprising the contact portion thereof.

5. The connector of claim 4 wherein said legs of the terminals are spaced sufficiently for also receiving a pressing portion of the actuator therebetween.

6. The connector of claim 1, including a pair of ground plates sandwiching the coaxial cables therebetween in an area of shielded sections of the cables.

7. The connector of claim 6, including a shield about at least a portion of the housing, the shield being engageable with at least one of said ground plates.

8. The connector of claim 1 wherein said wire management member includes means for retaining the conductor cores in said grooves.

9. The connector of claim 3 wherein said retaining means comprise restrictions generally at mouths of the grooves.

10. The connector of claim 4 wherein said restrictions comprise deformable tabs.

11. A connector for a plurality of generally parallel coaxial cables having fine conductor cores, comprising:

a dielectric housing having an elongated slot;

a plurality of terminals mounted on the housing in a side-by-side arrangement with insulation-displacement contact portions spaced along the slot for piercing through insulation about the conductor cores of the coaxial cables;

a wire management member having an elongated plate for insertion into the slot and including a plurality of side-by-side grooves on one side of the plate in a generally parallel array for receiving the conductor cores and spacing the cores in alignment with the insulation displacement portions of the terminals, the wire management member including means for retaining the conductor cores in the grooves; and an actuator separate from the wire management member for engaging the wire management member and biasing the conductor cores against the contact portions of the terminals.

12. The connector of claim 11 wherein said retaining means comprise restrictions generally at mouths of the grooves.

13. The connector of claim 12 wherein said restrictions comprise deformable tabs.

14. The connector of claim 11 wherein said terminals include bifurcated portions defining spaced legs between which the wire management member and conductor cores are inserted, one of said legs of each terminal comprising the contact portion thereof.

15. The connector of claim 14 wherein said legs of the terminals are spaced sufficiently for also receiving a pressing portion of the actuator therebetween.

16. The connector of claim 11, including a pair of ground plates sandwiching the coaxial cables therebetween in an area of shielded sections of the cables.

17. The connector of claim 16, including a shield about at least a portion of the housing, the shield being engageable with at least one of said ground plates.

* * * * *